US009545185B2

(12) United States Patent
Lee et al.

(10) Patent No.: US 9,545,185 B2
(45) Date of Patent: Jan. 17, 2017

(54) ADJUSTABLE UTENSIL TRAY WITH A DETERGENT DISPENSER AND MOVABLE DIVIDERS

(71) Applicant: Samsung Electronics Co., Ltd., Suwon-si, Gyeonggi-do (KR)

(72) Inventors: Joon J. Lee, San Bruno, CA (US); SooYeon Kwon, Pasadena, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/458,564

(22) Filed: Aug. 13, 2014

(65) Prior Publication Data

US 2015/0053238 A1 Feb. 26, 2015

Related U.S. Application Data

(60) Provisional application No. 61/877,862, filed on Sep. 13, 2013, provisional application No. 61/878,279, filed on Sep. 16, 2013, provisional application No. 61/870,154, filed on Aug. 26, 2013.

(51) Int. Cl.
*A47L 15/50* (2006.01)
*A47L 15/44* (2006.01)

(52) U.S. Cl.
CPC ..... *A47L 15/4409* (2013.01); *A47L 15/502* (2013.01); *A47L 15/503* (2013.01); *A47L 15/505* (2013.01)

(58) Field of Classification Search
CPC ..... A47L 15/503; A47L 15/505; A47L 15/50; A47L 15/502; A47L 15/4409; A47L 19/00; A47L 19/02; A47L 19/04; A47L 15/501; A47J 47/20
USPC ..... 211/41.1–41.9, 85.25, 132.1; 220/571, 220/572
See application file for complete search history.

(56) References Cited

U.S. PATENT DOCUMENTS 5,205,419 A 4/1993 Purtilo
5,344,029 A * 9/1994 Oghia ..... A47L 15/505 211/198
5,351,837 A 10/1994 Smith
6,138,693 A 10/2000 Matz
6,848,585 B2 2/2005 VanLandingham
(Continued)

FOREIGN PATENT DOCUMENTS

EP 0717953 A1 6/1996
EP 0962183 A1 12/1999
(Continued)

OTHER PUBLICATIONS

Morris, C., "Dishwasher Cutlery Racks & Baskets: Which is Best?", Aug. 11, 2011, pp. 1-4, Apartment Therapy, United States [downloaded from http://ww.apartmenttherapy.com/dishwasher-cutl-153348 on Sep. 19, 2013].
(Continued)

*Primary Examiner* — Joshua Rodden
*Assistant Examiner* — Hiwot Tefera
(74) *Attorney, Agent, or Firm* — Sherman IP LLP; Kenneth L. Sherman; Hemavathy Perumal

(57) ABSTRACT

One embodiment provides a dishwashing apparatus having a utensil rack including a configurable rack layout, and a first rack layout adjustment device coupled to the utensil rack for configuring the rack layout.

21 Claims, 10 Drawing Sheets

(56) References Cited

U.S. PATENT DOCUMENTS

| | | | | |
|---|---|---|---|---|
| 7,231,929 | B2 | 6/2007 | Landsiedel et al. | |
| 7,445,128 | B2 * | 11/2008 | Kaczmarek | A47L 15/502 211/150 |
| 7,854,806 | B2 | 12/2010 | Cho et al. | |
| 7,886,917 | B1 * | 2/2011 | Berger | A47B 45/00 211/133.5 |
| 8,104,628 | B2 * | 1/2012 | Kim | 211/41.8 |
| 8,196,593 | B2 | 6/2012 | Schessl et al. | |
| 2006/0108298 | A1 * | 5/2006 | Kim | 211/41.8 |
| 2006/0254992 | A1 | 11/2006 | Lim | |
| 2007/0272272 | A1 | 11/2007 | Choi et al. | |
| 2010/0078048 | A1 * | 4/2010 | Schessl | A47L 15/502 134/115 R |
| 2010/0155280 | A1 | 6/2010 | Graute et al. | |
| 2010/0212700 | A1 * | 8/2010 | Wattley et al. | 134/93 |
| 2011/0247990 | A1 | 10/2011 | Chai | |
| 2012/0031432 | A1 | 2/2012 | Beaudet et al. | |
| 2012/0090643 | A1 * | 4/2012 | Bertsch et al. | 134/25.2 |
| 2012/0138092 | A1 | 6/2012 | Ashrafzadeh et al. | |
| 2012/0279978 | A1 * | 11/2012 | Da Pont et al. | 220/810 |
| 2012/0292270 | A1 * | 11/2012 | Klump et al. | 211/41.8 |
| 2012/0298155 | A1 | 11/2012 | Blanchard et al. | |
| 2013/0069506 | A1 | 3/2013 | Bennett et al. | |
| 2013/0104944 | A1 | 5/2013 | Motabar et al. | |
| 2014/0190528 | A1 * | 7/2014 | Wegener | A47L 15/502 134/92 |
| 2015/0053237 | A1 | 2/2015 | Lee et al. | |
| 2015/0245761 | A1 * | 9/2015 | Zhou | A47L 15/502 211/70.7 |

FOREIGN PATENT DOCUMENTS

| | | | |
|---|---|---|---|
| EP | 1192893 | A2 | 4/2002 |
| EP | 1530942 | A1 | 5/2005 |
| EP | 2030556 | A1 | 3/2009 |
| WO | 2009083576 | A1 | 7/2009 |
| WO | WO2009/083576 | A1 * | 7/2009 |

OTHER PUBLICATIONS

Extended European Search Report dated Aug. 18, 2015 for European Application No. 15150695.3 from European Patent Office, pp. 1-7, Munich, Germany.

* cited by examiner

ADJUSTABLE UTENSIL TRAY WITH A DETERGENT DISPENSER AND MOVABLE DIVIDERS

CROSS-REFERENCE TO RELATED APPLICATIONS

This application claims priority to U.S. Provisional Patent Application Ser. No. 61/877,862, filed on Sep. 13, 2013, U.S. Provisional Patent Application Ser. No. 61/878,279, filed on Sep. 16, 2013, and U.S. Provisional Patent Application Ser. No. 61/870,154, filed on Aug. 26, 2013. U.S. Provisional Patent Application Ser. No. 61/877,862, U.S. Provisional Patent Application Ser. No. 61/878,279 and U.S. Provisional Patent Application Ser. No. 61/870,154 are incorporated herein by reference.

TECHNICAL FIELD

One or more embodiments relate generally to dishwashing technology, and in particular, a dishwashing machine with an adjustable utensil tray with a detergent dispenser and movable dividers.

BACKGROUND

A conventional dishwashing machine includes an in-door detergent dispenser for maintaining detergent for washing objects loaded into the dishwashing machine. As the dispenser is integrated with a dishwasher door of the dishwashing machine, it may be difficult for a user to access and load detergent into the dispenser. Further, the dishwasher door may need to be removed when resolving problems associated with the dispenser (e.g., a stuck dispenser) as some parts of the dispenser may only be accessed when the dishwasher door is removed. Therefore, the placement of the dispenser within the dishwashing machine needs to be adjusted to optimize the dishwashing machine for ergonomic use and improve efficiency.

SUMMARY

One embodiment provides a dishwashing apparatus comprising a utensil rack including a configurable rack layout, and a first rack layout adjustment device coupled to the utensil rack for configuring the rack layout.

Another embodiment provides a dishwashing apparatus comprising a dish rack, a utensil rack disposed above the dish rack, and a detergent dispenser disposed within the utensil rack.

These and other aspects and advantages of one or more embodiments will become apparent from the following detailed description, which, when taken in conjunction with the drawings, illustrate by way of example the principles of one or more embodiments.

BRIEF DESCRIPTION OF THE DRAWINGS

For a fuller understanding of the nature and advantages of one or more embodiments, as well as a preferred mode of use, reference should be made to the following detailed description read in conjunction with the accompanying drawings, in which.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

Figure 1:
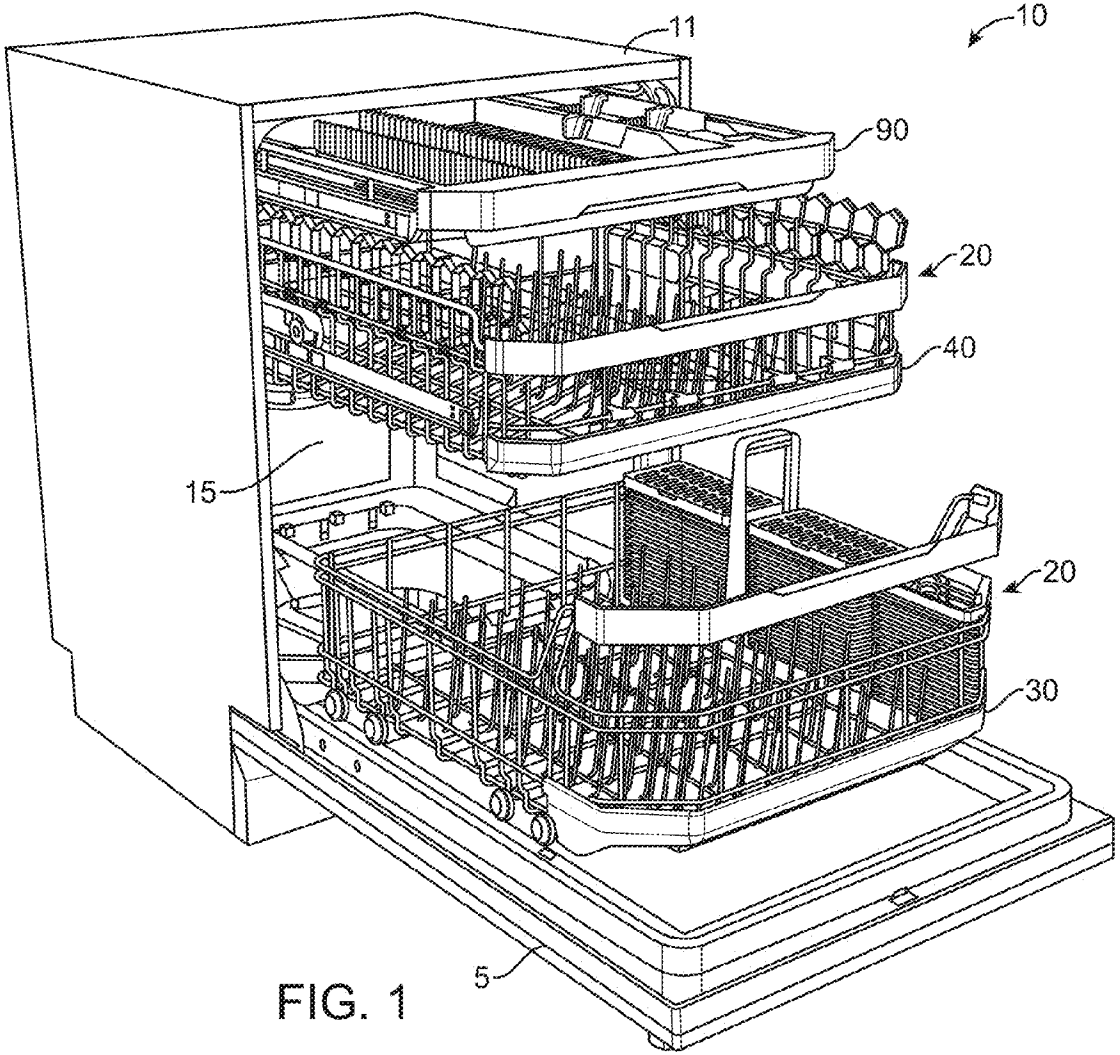
FIG. 1 illustrates a front perspective view of an example embodiment of a dishwashing apparatus.

FIG. 1 illustrates a front perspective view of an example embodiment of a dishwashing apparatus 10. The apparatus 10 comprises a housing 11 with an interior cavity 15 for maintaining at least one dish rack 20, and a dishwasher door 5 pivotally coupled to the housing 11. For example, the apparatus 10 may include a first dish rack 30 and a second dish rack 40, wherein the second dish rack 40 is positioned above, and substantially horizontal to, the first dish rack 30. Each dish rack 20 has a rack layout that may be manually adjusted to receive and maintain objects of various shapes and sizes, such as plates, cups, bowls, pots, pans, etc.

The apparatus 10 further comprises at least one utensil rack 90 shaped to receive and maintain smaller sized objects, such as cutlery, flatware and other utensils. The utensil rack 90 is positioned above, and substantially horizontal to, the second dish rack 40.

When the door 5 is open, each rack 20, 90 is horizontally slidable into and out of the interior cavity 15. For example, as shown in FIG. 1, the racks 20 and 90 are slid out of the interior cavity 15, permitting easy access to the racks 20 and 90 for loading objects onto, or unloading objects from, the racks 20 and 90.

The racks 20 and 90 may be slid into the interior cavity 15 after a user has completed loading objects onto, or unloading objects from, the racks 20 and 90. If the objects loaded onto the racks 20 and 90 are unwashed, a wash cycle for washing the objects may be initiated when the user closes the door 5.

Figure 2:
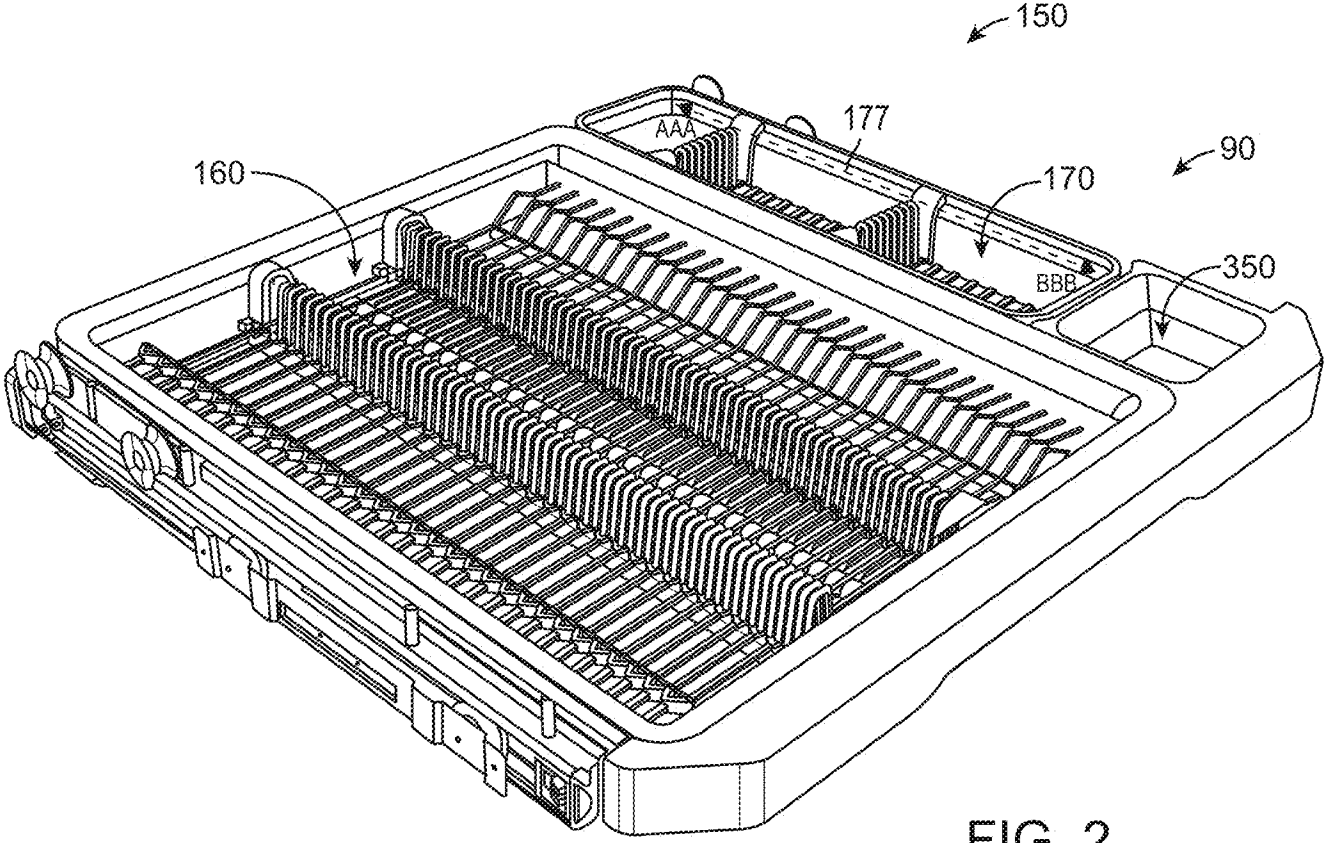
FIG. 2 illustrates a top perspective view of an example embodiment of a utensil rack configuration.
Figure 3:
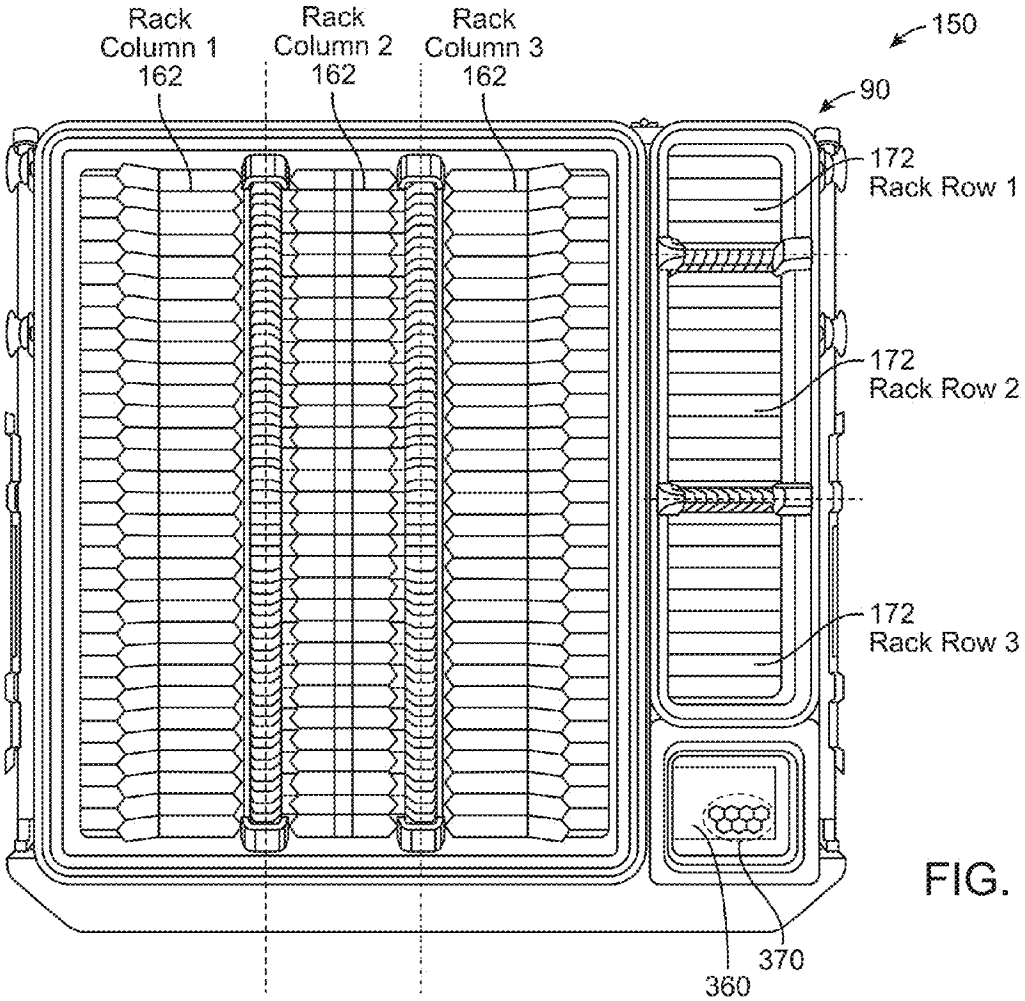
FIG. 3 illustrates a top view of an example embodiment of a utensil rack configuration.

FIGS. 2 and 4-6 illustrate different top perspective views of an example embodiment of a utensil rack configuration 150 for the utensil rack 90. FIG. 3 illustrates a top view of the example embodiment of the utensil rack configuration 150. When configured in accordance with the utensil rack configuration 150, the utensil rack 90 includes a rack frame 91 (FIG. 4) with multiple sides. The rack frame 91 includes a first pair of opposing sides 91A and 91B (FIG. 6), and a second pair of opposing sides 91C and 91D (FIG. 6), wherein each side 91A, 91B is substantially perpendicular to the sides 91C and 91D. The side 91A and the side 91B represent the front side and the rear side of the rack frame 91, respectively.

Figure 6:
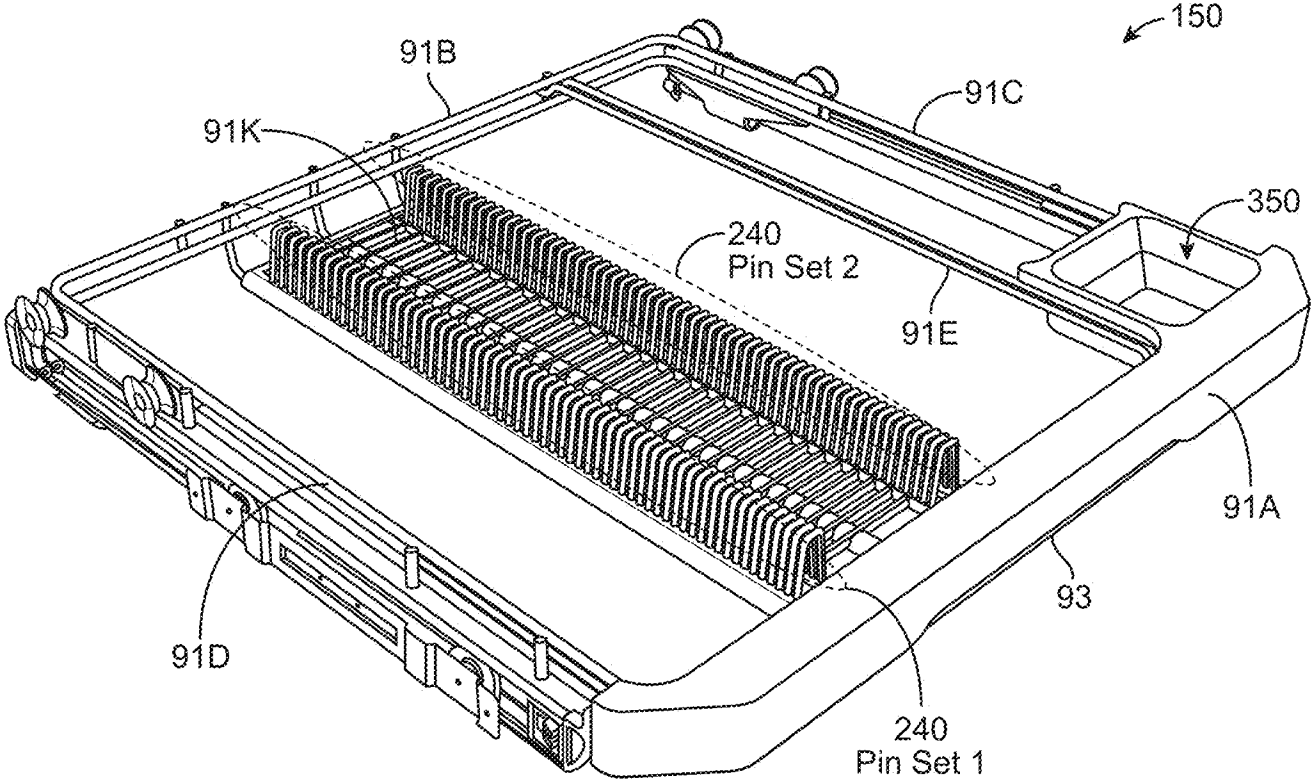
FIG. 6 illustrates a top perspective view of an example embodiment of a utensil rack configuration.

The rack frame 91 further includes a support member 91K (FIG. 6). In one example embodiment, the support member 91K may be substantially perpendicular to the sides 91A and 91B. The support member 91K may include one or more sets of recessing pins 240 (FIG. 6). Each set of recessing pins 240 may comprise at least two recessing pins. A set of recessing pins 240 may be located along a lengthwise edge of the support member 91K. For example, in one embodiment, the support member 91K includes two sets of recessing pins 240—a first set of recessing pins 240 (Pin Set 1) located lengthwise along a first lengthwise edge of the support member 91K, and a second set of recessing pins 240 (Pin Set 2) located lengthwise along an opposite lengthwise edge of the support member 91K. The second set of recessing pins 240 may be parallel to the first set of recessing pins 240. Each set of recessing pins 240 is shaped to receive cutlery, flatware or other utensils.

In another embodiment, the support member 91K includes only one set of recessing pins 240 located lengthwise along a center of the support member 91K. In yet another embodiment, the recessing pins 240 may be slightly offset such that objects loaded onto the utensil rack 90 may be staggered.

The utensil rack 90 further includes a handle bar 93 (FIG. 6) coupled to the side 91A of the rack frame 91. When the door 5 is open, a user may utilize the handle bar 93 to horizontally slide the utensil rack 90 into, or out of, the interior cavity 15.

Figure 4:
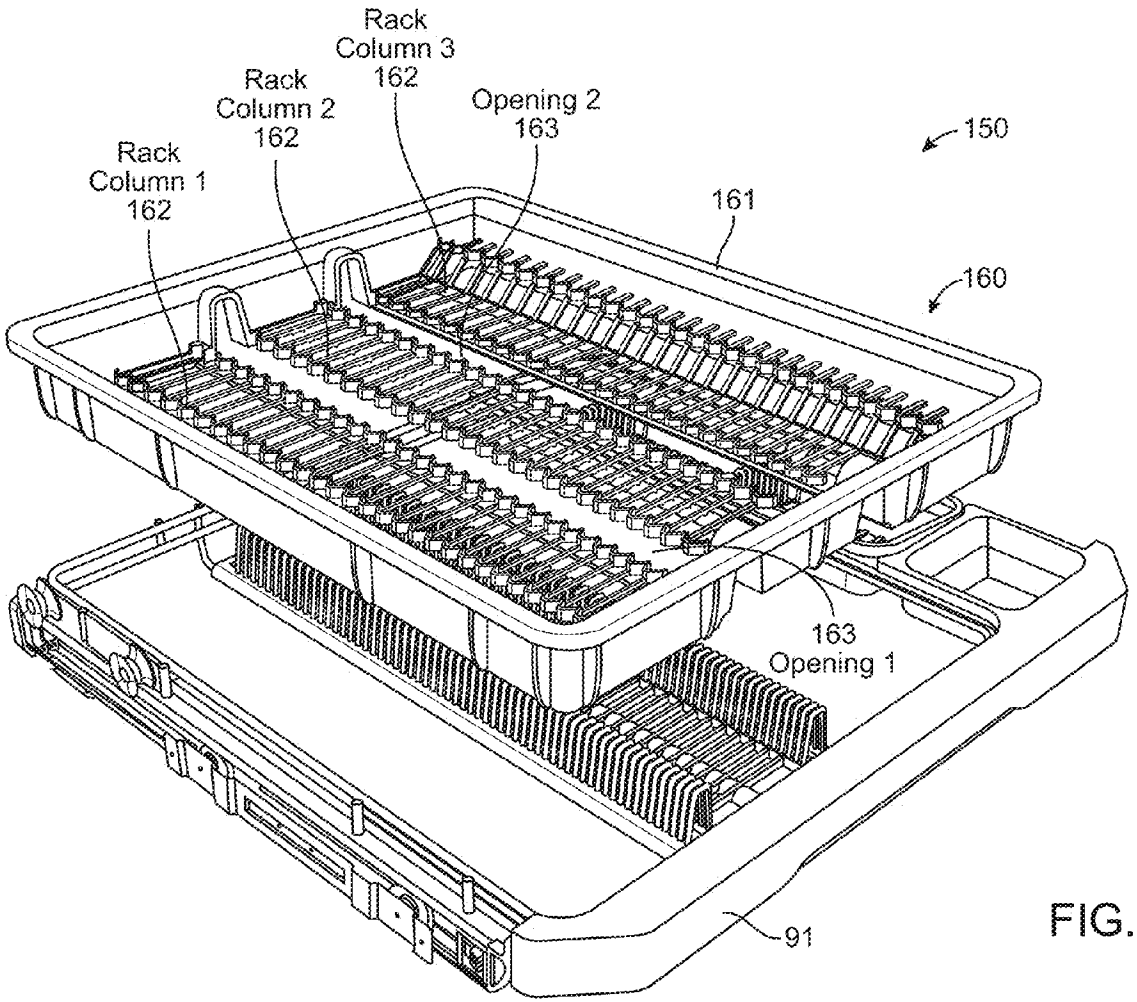
FIG. 4 illustrates a top perspective view of an example embodiment of a utensil rack configuration.
Figure 5:
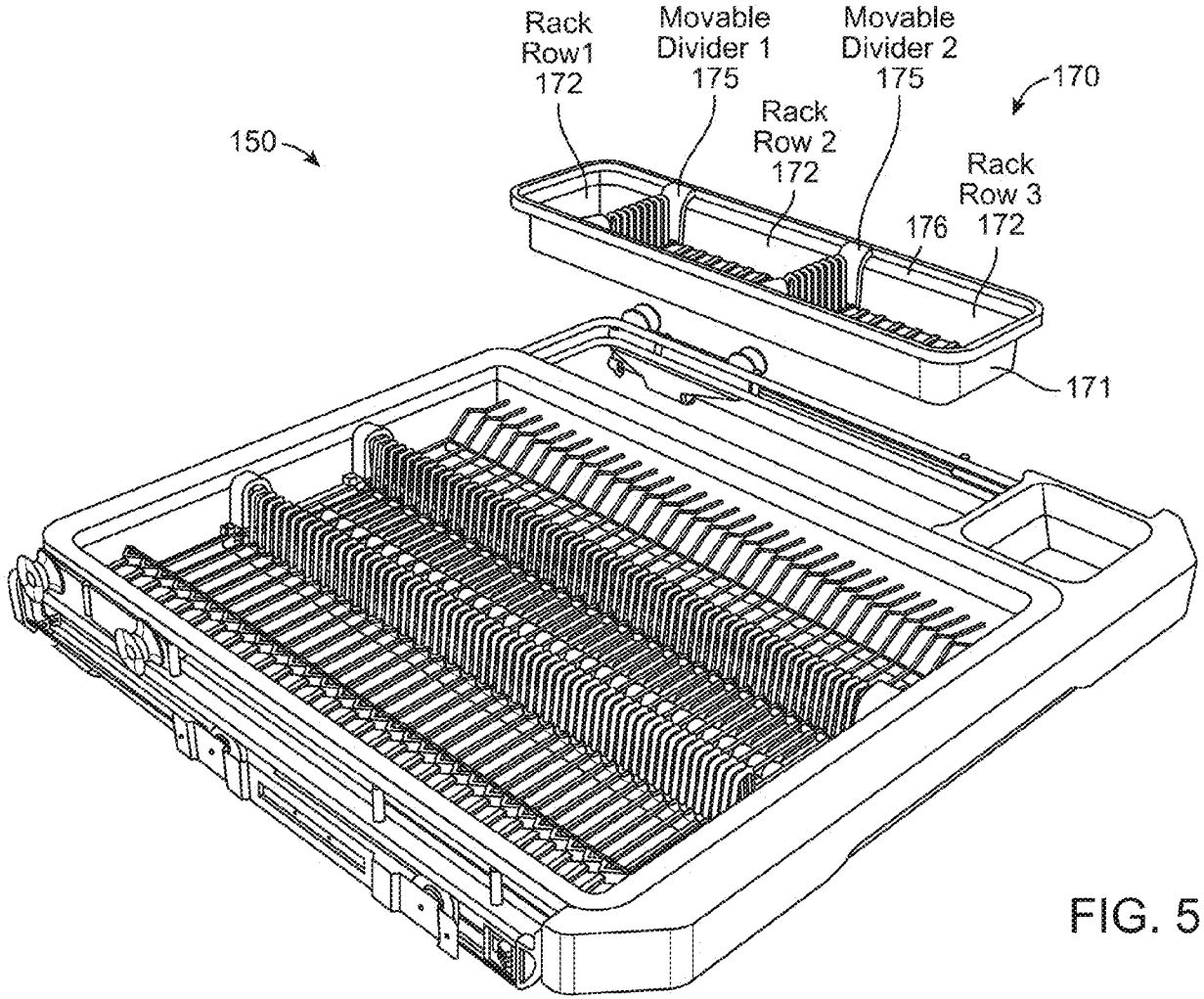
FIG. 5 illustrates a top perspective view of an example embodiment of a utensil rack configuration.

The utensil rack 90 further comprises one or more removable trays for maintaining objects. As shown in FIG. 2, in the example rack configuration 150, the utensil rack 90 includes a first removable tray 160 and a second removable tray 170. In FIG. 4, the first tray 160 is shown removed from the rack frame 91. In FIG. 5, the second tray 170 is shown removed from the rack frame 91. In FIG. 6, both the first tray 160 and the second tray 170 are removed from the rack frame 91.

A bottom portion of each tray 160, 170 may include wires, holes, staggered hexagons or other structural configurations that allow water to pass through during a wash cycle.

In one embodiment, a member 91E (FIG. 6) of the rack frame 91 extending between the sides 91A and 91B, and substantially parallel to the sides 91C and 91D, partitions the first tray 160 from the second tray 170. Other configurations of the member 91E may be used to accommodate different shapes or sizes of the first tray 160 and the second tray 170. In another embodiment, a member 91E is not needed (e.g., the first tray 160 and the second tray 170 fit to the remaining sides of the utensil rack 90, or using each other as support/boundary).

In one embodiment, the first tray 160 may be larger than the second tray 170, such that the first tray 160 can accommodate placement of more objects than the second tray 170.

In FIG. 4, the first tray 160 is shown removed from the rack frame 91. The first tray 160 includes a removable tray frame 161 (FIG. 4) for maintaining objects loaded/placed onto the first tray 160. The tray frame 161 may include openings shaped to receive recessing pins 240 of the support member 91K. In one example embodiment, the tray frame 161 includes a first opening 163 (Opening 1) and a second opening 163 (Opening 2) that are spaced apart. When the tray frame 161 is inserted into the rack frame 91, the first and the second openings 163 are shaped to receive the first and second sets of recessing pins 240, respectively. In one embodiment, the sets of recessing pins 240 may serve as dividers that partition the first tray 160 into multiple sections. For example, the first and second sets of recessing pins 240 partition the tray frame 161 into multiple rack columns 162, such as a first rack column 162 (Rack Column 1), a second rack column 162 (Rack Column 2) and a third rack column 162 (Rack Column 3). Each rack column 162 accommodates placement of objects.

The second tray 170 includes a removable tray frame 171 for maintaining objects loaded/placed onto the second tray 170. The second tray 170 may further include at least one movable/adjuster divider 175 (FIG. 5) for partitioning the second tray 170 into multiple rack rows 172. Each rack row 172 may accommodate placement of objects.

In one embodiment, the second tray 170 includes a first movable divider 175 (Movable Divider 1) and a second movable divider 175 (Movable Divider 2). The dividers 175 partition the second tray 170 into multiple rack rows 172, such as a first rack row 172 (Rack Row 1), a second rack row 172 (Rack Row 2) and a third rack row 172 (Rack Row 3).

Each divider 175 may be slidably coupled to a guide track 176 (FIG. 5) along a portion of the removable tray frame 171. Each divider 175 may be manually slidable back and forth in a direction 177 (FIG. 2) along the guide track 176 to adjust a layout configuration of the second tray 170. For example, if the second tray 170 is positioned horizontally, the dividers 175 are movable along the guide track 176 in a horizontal direction to adjust the sizes of the rack rows 172 to accommodate contents of various shapes and sizes.

The size of the first rack row 172 may be minimized by sliding the first movable divider 175 to one end AAA (FIG. 2) of the guide track 176. The size of the third rack row 172 may be minimized by sliding the second movable divider 175 to an opposing end BBB (FIG. 2) of the guide track 176. Minimizing the size of both the first and third rack rows 172 maximizes the size of the second rack row 172.

Each divider 175 may comprise a set of recessing pins 240 shaped for receiving cutlery, flatware or other utensils.

The utensil rack 90 further includes a detergent dispenser 350 with an interior cavity 360 (FIG. 3) for maintaining detergent. In one embodiment, the detergent dispenser 350 is integrated with the rack frame 91.

The detergent dispenser 350 further includes a set of openings 370 (FIG. 3) for dispensing detergent loaded into the detergent dispenser 350. The apparatus 10 further includes an actuator unit configured to actuate the openings 370 to dispense the detergent during a wash cycle (e.g., the actuator unit may send a current to cause the openings 370 to open during a wash cycle). The actuator unit may be activated by water spray pressure during a wash cycle. In one embodiment, the actuator unit may be an electromechanical or electromagnetic solenoid. In another embodiment, the actuator unit may be a bi-metallic strip, a switch, a spring or a magnet activated by water spray pressure during a wash cycle. The actuator unit may be integrated into the detergent dispenser 350, or may be disposed within proximity of the detergent dispenser 350.

Figure 7:
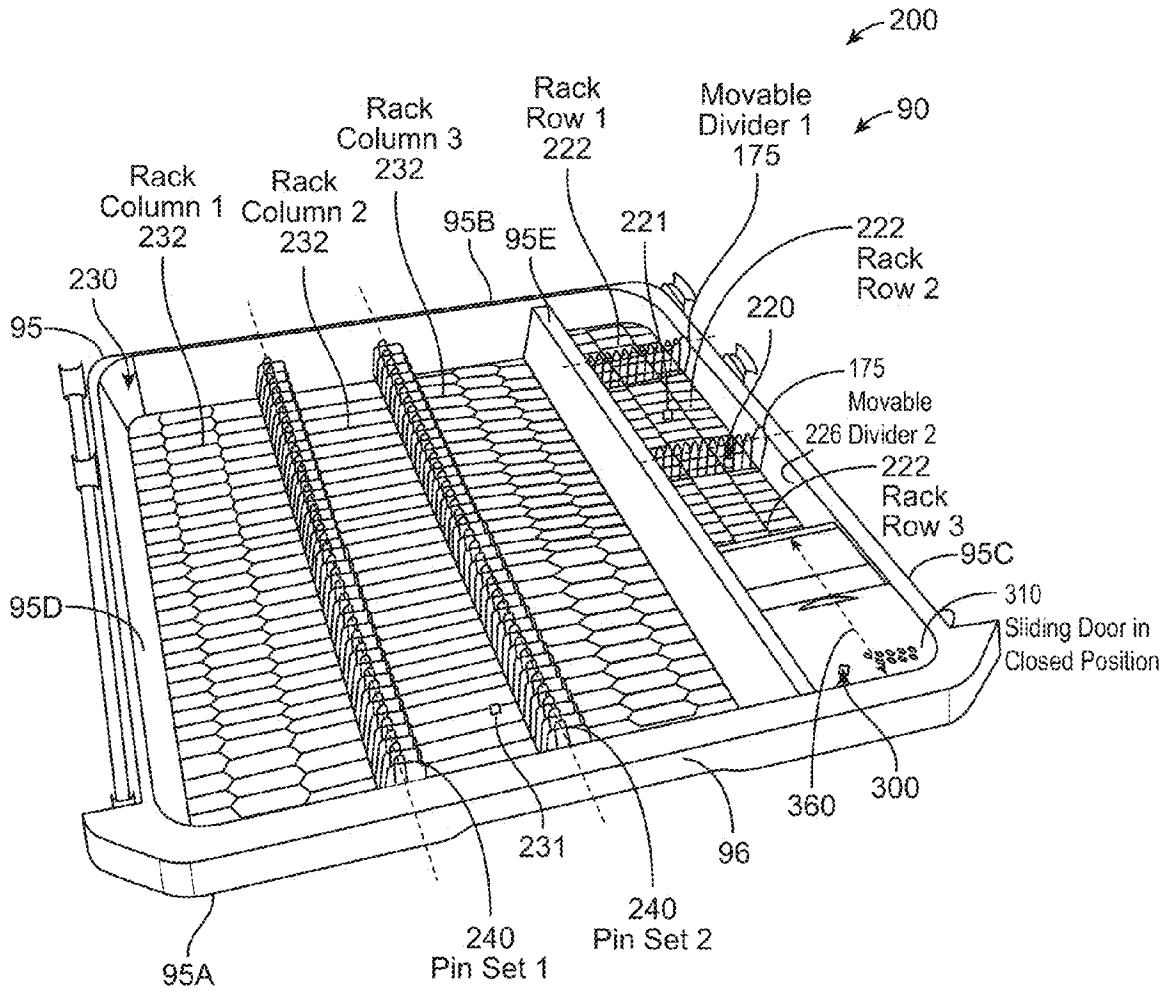
FIG. 7 illustrates a top perspective view of an example embodiment of a utensil rack configuration.

FIG. 7 illustrates a top perspective view of another example embodiment of a utensil rack configuration 200. When configured in accordance with the utensil rack configuration 200, the utensil rack 90 includes a rack frame 95 with multiple sides. The rack frame 95 includes a first pair of opposing sides 95A and 95B, and a second pair of opposing sides 95C and 95D, wherein each side 95A, 95B is substantially perpendicular to the sides 95C and 95D. The side 95A and the side 95B represent the front side and the rear side of the rack frame 95, respectively.

The utensil rack 90 further includes a handle bar 96 coupled to the side 95A of the rack frame 95. When the door 5 is open, a user may utilize the handle bar 96 to horizontally slide the utensil rack 90 into, or out of, the interior cavity 15.

The utensil rack 90 further comprises one or more trays for maintaining objects. Unlike the example utensil rack configuration 150 in FIGS. 2-6, the trays in the example rack configuration 200 are non-removable. As shown in FIG. 7, the utensil rack 90 includes a first tray 230 and a second tray 220. A side 95E of the rack frame 91 extending between the sides 95A and 95B, and substantially parallel to the sides 95C and 95D, partitions the first tray 230 from the second tray 220.

The first tray 230 includes a bottom surface 231 for maintaining objects loaded/placed onto the first tray 230. The first tray 230 may further include one or more sets of recessing pins 240 fixedly coupled to the bottom surface 231 of the first tray 230. Each set of recessing pins 240 may comprise at least two recessing pins. A set of recessing pins 240 may be located lengthwise along the first tray 230. For example, in one embodiment, the first tray 230 includes two sets of recessing pins 240—a first set of recessing pins 240 (Pin Set 1) located lengthwise along the first tray 230, and a second set of recessing pins 240 (Pin Set 2) located lengthwise along the first tray 230, wherein the second set of recessing pins 240 may be parallel to the first set of recessing pins 240.

In another embodiment, the first tray 230 includes only one set of recessing pins 240 located lengthwise along the first tray 230. In yet another embodiment, the recessing pins 240 may be slightly offset such that objects loaded onto the first tray 230 may be staggered.

In one embodiment, the sets of recessing pins 240 may serve as dividers that partition the first tray 230 into multiple sections. For example, the first and second sets of recessing pins 240 partition the first tray 230 into multiple rack columns 232, such as a first rack column 232 (Rack Column 1), a second rack column 232 (Rack Column 2) and a third rack column 232 (Rack Column 3). Each rack column 232 accommodates placement of objects. Each set of recessing pins 240 is shaped to receive cutlery, flatware or other utensils.

The second tray 220 includes a bottom surface 221 for maintaining objects loaded/placed onto the second tray 220. The second tray 220 further includes at least one movable/slidable divider 175 for partitioning the second tray 220 into multiple rack rows 222. Each rack row 222 accommodates placement of objects.

In one embodiment, the second tray 220 includes a first movable divider 175 (Movable Divider 1) and a second movable divider 175 (Movable Divider 2). The dividers 175 partition the second tray 220 into multiple rack rows 222, such as a first rack row 222 (Rack Row 1), a second rack row 222 (Rack Row 2) and a third rack row 222 (Rack Row 3).

Each divider 175 is slidably coupled to a guide track 226 along a portion of the side 95C of the rack frame 95. Each divider 175 is manually slidable back and forth along the guide track 226 to adjust a layout configuration of the second tray 220. For example, the dividers 175 are movable along the guide track 226 to adjust the sizes of the rack rows 222 to accommodate placement of objects of different shapes and sizes.

Each divider 175 may comprise a set of recessing pins 240 shaped for receiving cutlery, flatware or other utensils.

Figure 9:
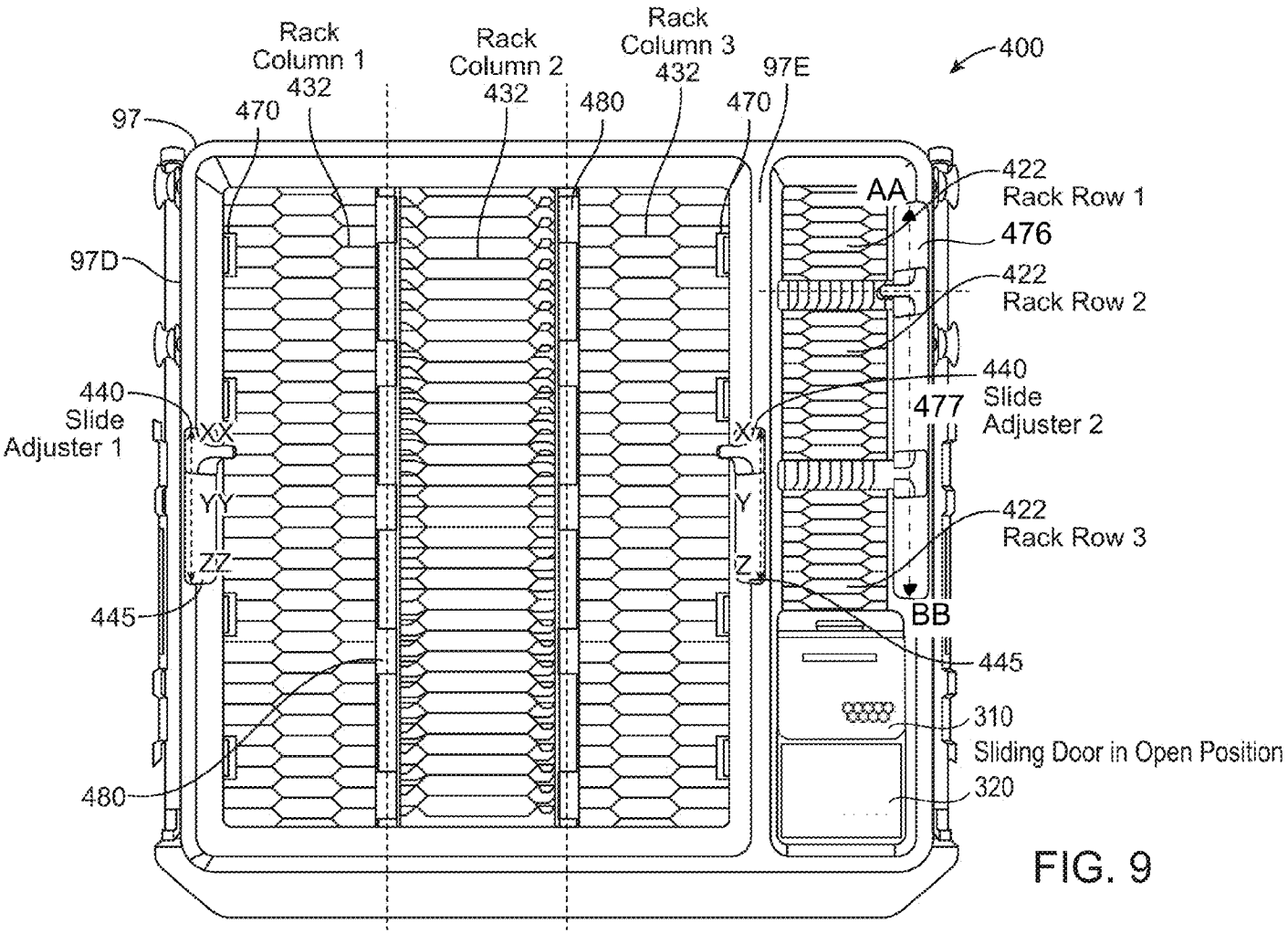
FIG. 9 illustrates a top view of an example embodiment of a utensil rack configuration.

The utensil rack 90 further includes a detergent dispenser 300 with one or more interior compartments 320 (FIG. 9) for maintaining detergent. The detergent dispenser 300 includes a sliding door 310 that is manually slidable back and forth along a direction 360 between a closed position A as shown in FIG. 7, and an open position B as shown in FIG. 9. In one embodiment, the detergent dispenser 300 is integrated with the rack frame 95.

The detergent dispenser 300 further includes a set of openings 370 (FIG. 3) for dispensing detergent loaded into the detergent dispenser 300. The apparatus 10 further includes an actuator unit configured to actuate the openings 370 to dispense the detergent during a wash cycle (e.g., the actuator unit may send a current to cause the openings 370 to open during a wash cycle). In one embodiment, the actuator unit may be an electromechanical or electromagnetic solenoid. In another embodiment, the actuator unit may be a bi-metallic strip, a switch, a spring or a magnet activated by water spray pressure during a wash cycle. The actuator unit may be integrated into the detergent dispenser 300, or may be disposed within proximity of the detergent dispenser 300.

Figure 8:
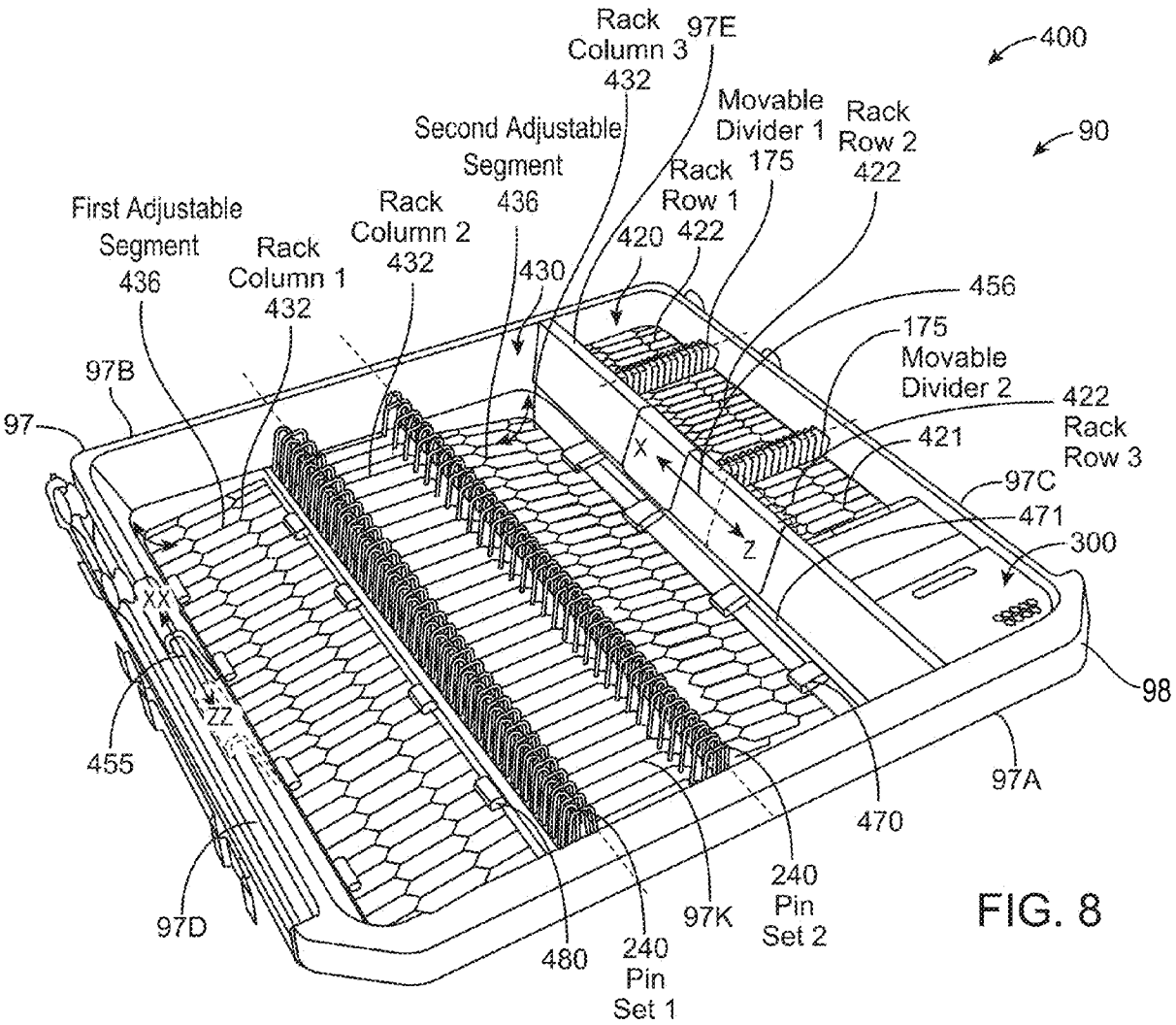
FIG. 8 illustrates a front perspective view of an example embodiment of a utensil rack configuration.

FIG. 8 illustrates a front perspective view of an example embodiment of a utensil rack configuration 400. When configured in accordance with utensil rack configuration 400, the utensil rack 90 includes a rack frame 97 with multiple sides. The rack frame 97 includes a first pair of opposing sides 97A and 97B, and a second pair of opposing sides 97C and 97D, wherein each side 97A, 97B is substantially perpendicular to the sides 97C and 97D. The side 97A and the side 97B represent the front side and the rear side of the rack frame 97, respectively.

The utensil rack 90 further includes a handle bar (coupled to the side 97A of the rack frame 97. When the door 5 is open, a user may utilize the handle bar 98 to horizontally slide the utensil rack 90 into, or out of, the interior cavity 15.

The utensil rack 90 further comprises one or more trays for maintaining objects. Unlike the example utensil rack configuration 150 in FIGS. 2-6, the trays in the example rack configuration 400 are non-removable. In the example rack configuration 400 shown in FIG. 8, the utensil rack 90 includes a first tray 430 and a second tray 420. In one embodiment, a member 97E of the rack frame 97 extending between the sides 97A and 97B, and substantially parallel to the sides 97C and 97D, partitions the first tray 430 from the second tray 420. Other configurations of the member 97E may be used to accommodate different shapes or sizes of the first tray 430 and the second tray 420. In another embodiment, a member 97E is not needed (e.g., the first tray 430 and the second tray 420 fit to the remaining sides of the utensil rack 90, or using each other as support/boundary).

The first tray 430 further includes a support member 97K. In one example embodiment, the support member 97K may be substantially perpendicular to the sides 97A and 97B. The support member 97K may include one or more sets of recessing pins 240. Each set of recessing pins 240 may comprise at least two recessing pins. A set of recessing pins 240 may be located lengthwise along the support member 97K. For example, in one embodiment, the support member 97K includes two sets of recessing pins 240—a first set of recessing pins 240 (Pin Set 1) located lengthwise along the support member 91K, and a second set of recessing pins 240 (Pin Set 2) located lengthwise along the support member 91K. The second set of recessing pins 240 may be parallel to the first set of recessing pins 240. Each set of recessing pins 240 is shaped to receive cutlery, flatware or other utensils.

In another embodiment, the support member 97K includes only one set of recessing pins 240 located lengthwise along a center of the support member 97K. In yet another embodiment, the recessing pins 240 may be slightly offset such that objects loaded onto the utensil rack 90 may be staggered.

In one embodiment, the sets of recessing pins 240 may serve as dividers that partition the first tray 430 into multiple sections. For example, the first and second sets of recessing pins 240 partition the first tray 430 into multiple rack columns 432, such as a first rack column 432 (Rack Column 1), a second rack column 432 (Rack Column 2) and a third rack column 432 (Rack Column 3). Each rack column 432 accommodates placement of objects.

A layout configuration of the first tray 430 is adjustable. Specifically, the first rack column 432 has a corresponding first adjustable segment 436. The third rack column 432 has a corresponding second adjustable segment 436.

In one embodiment, one end of the first adjustable segment 436 is pivotally coupled to a first slide adjuster 440 (FIG. 9) via one or more swing hinges 470 and a first rotatable member 471. The first slide adjuster 440 is slidably coupled to a guide track 445 (FIG. 9) disposed along a portion of the side 97D. An opposing end of the first adjustable segment 436 is coupled to the support member 97K via one or more hinges 480.

Figure 10:
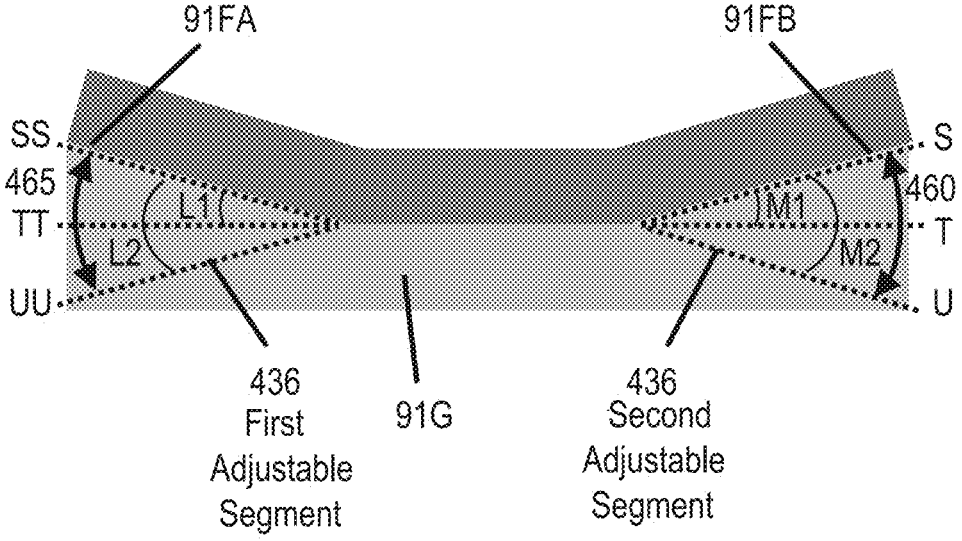
FIG. 10 illustrates example rotation ranges for an example embodiment of a utensil rack configuration.

Manually sliding the first slide adjuster 440 back and forth in a direction 455 along the guide track 445 rotates the first adjustable segment 436 along a direction 465 (FIG. 10) between different positions. In one embodiment, the first adjustable segment 436 may be positioned anywhere along the direction 465 between a raised tilt position SS (FIG. 10) through a lowered tilt position UU (FIG. 10). For example, the first adjustable segment 436 may be lowered, from the raised tilt position SS, or raised, from the lowered tilt position UU, to a substantially horizontal position TT (FIG. 10).

One end of the second adjustable segment 436 is pivotally coupled to a second slide adjuster 440 via one or more swing hinges 470 and a second rotatable member 471. The second slide adjuster 440 is slidably coupled to a guide track 445 disposed along a portion of the side 97E. An opposing end of the second adjustable segment 436 is coupled to the support member 97K via one or more hinges 480.

Manually sliding the second slide adjuster 440 back and forth in a direction 456 along the guide track 445 rotates the second adjustable segment 436 along a direction 460 (FIG. 10) between different positions. In one embodiment, the second adjustable segment 436 may be positioned anywhere along the direction 460 between a raised tilt position S (FIG. 10) through a lowered tilt position U (FIG. 10). For example, the first adjustable segment 436 may be lowered from the raised tilt position S, or raised from the lowered tilt position U, to a substantially horizontal position T (FIG. 10).

In other embodiments, other mechanisms may also be used to raise/lower the adjustable segments 436, such as Mielie's mechanism, hooks, etc.

The first adjustable segment 436 and the second adjustable segment 436 may be individually rotated to adjust a depth of the first and third rack columns 432, respectively, to accommodate objects of various shapes and sizes.

The second tray 420 includes a bottom surface 421 for maintaining objects loaded/placed onto the second tray 420. The second tray 420 further includes at least one movable divider 175 for partitioning the second tray 420 into multiple rack rows 422. Each rack row 422 accommodates placement of objects.

In one embodiment, the second tray 420 includes a first movable divider 175 (Movable Divider 1) and a second movable divider 175 (Movable Divider 2). The dividers 175 partition the second tray 420 into multiple rack rows 422, such as a first rack row 422 (Rack Row 1), a second rack row 422 (Rack Row 2) and a third rack row 422 (Rack Row 3).

Each divider 175 is slidably coupled to a guide track 476 (FIG. 9) disposed along a portion of the side 97C. Each divider 175 may be manually slidable back and forth in a direction 477 along the guide track 476 to adjust a layout configuration of the second tray 420. For example, if the second tray 420 is positioned horizontally, the dividers 175 are movable along the guide track 476 in a horizontal direction to adjust the sizes of the rack rows 422 to accommodate placement of objects of different shapes and sizes. The size of the first rack row 422 may be minimized by sliding the first movable divider 175 to one end AA (FIG. 9) of the guide track 476. The size of the third rack row 422 may be minimized by sliding the second movable divider 175 to an opposing end BB (FIG. 9) of the guide track 476. Minimizing the size of both the first and third rack rows 422 maximizes the size of the second rack row 422.

Each divider 175 may comprise a set of recessing pins 240 shaped for receiving cutlery, flatware or other utensils.

The utensil rack 90 further includes a detergent dispenser 300 with one or more interior compartments 320 for maintaining detergent. In one embodiment, the detergent dispenser 300 is integrated with the rack frame 97.

FIG. 9 illustrates a top view of the example rack configuration 400 for the utensil rack 90, wherein the adjustable segments 436 are raised, in accordance with an embodiment of the invention. The first adjustable segment 436 may be raised to the raised tilt position SS to minimize the depth of the first rack column 432, thereby allowing more room to load large and/or tall objects (e.g., long-stemmed wine glasses or tall glasses) onto the second dish rack 40. Similarly, the second adjustable segment 436 may be raised to the raised tilt position S to minimize the depth of the third rack column 432, thereby allowing more room to load large and/or tall objects (e.g., long-stemmed wine glasses or tall glasses) onto the second dish rack 40.

In one embodiment, manually sliding the first slide adjuster 440 to a first position XX along the guide track 445 raises the first adjustable segment 436 to the raised tilt position SS, manually sliding the first slide adjuster 440 to a second position YY along the guide track 445 lowers the first adjustable segment 436 to the substantially horizontal position TT, and manually sliding the first slide adjuster 440 to a third position ZZ along the guide track 445 lowers the first adjustable segment 436 to the lowered tilt position UU.

In one embodiment, manually sliding the second slide adjuster 440 to a first position X along the guide track 445 raises the second adjustable segment 436 to the raised tilt position S, manually sliding the second slide adjuster 440 to a second position Y along the guide track 445 lowers the second adjustable segment 436 to the substantially horizontal position T, and manually sliding the second slide adjuster 440 to a third position Z along the guide track 445 lowers the second adjustable segment 436 to the lowered tilt position U.

The first adjustable segment 436 may be lowered to the substantially horizontal position TT to increase the depth of the first rack column 432, thereby allowing more room to load objects onto the first rack column 432. Similarly, the second adjustable segment 436 may be lowered to the substantially horizontal position T to increase the depth of the third rack column 432, thereby allowing more room to load objects onto the third rack column 432.

The first adjustable segment 436 may be further lowered to the substantially horizontal position UU to maximize the depth of the first rack column 432 and maximize the amount of room available for loading objects onto the first rack column 432. Similarly, the second adjustable segment 436 may be further lowered to the substantially horizontal position U to maximize the depth of the third rack column 432 and maximize the amount of room available for loading objects onto the third rack column 432.

FIG. 10 illustrates example rotation ranges for the adjustable segments 436, in accordance with an embodiment of the invention. The first adjustable segment 436 may be positioned anywhere along the direction 465 between the raised tilt position SS through a lowered tilt position UU. For example, the first adjustable segment 436 may be raised to the raised tilt position SS, wherein one end of the first adjustable segment 436 lies flush against an end 91FA of an underside 91G of the side 97B. From the raised tilt position SS, the first adjustable segment 436 may be lowered along a rotation angle L1 to the substantially horizontal position TT. From the raised tilt position SS, the first adjustable segment 436 may also be lowered along a rotation angle L2 to the lowered tilt position UU, wherein the rotation angle L2 is larger than the rotation angle L1.

The second adjustable segment 436 may be positioned anywhere along the direction 460 between the raised tilt position S through a lowered tilt position U. For example, the second adjustable segment 436 may be raised to the raised tilt position S, wherein one end of the second adjustable segment 436 lies flush against an end 91FB of an underside of the side 97B. From the raised tilt position S, the second adjustable segment 436 may be lowered along a rotation angle M1 to the substantially horizontal position T. From the raised tilt position S, the second adjustable segment 436 may also be lowered along a rotation angle M2 to the lowered tilt position U, wherein the rotation angle M2 is larger than the rotation angle M1.

Though the one or more embodiments have been described with reference to certain versions thereof; however, other versions are possible. Therefore, the spirit and scope of the appended claims should not be limited to the description of the preferred versions contained herein.

What is claimed is:

1. A dishwashing apparatus, comprising:

a utensil rack comprising a bottom surface partitioned into multiple sections, wherein at least one of the multiple sections is an adjustable section individually rotatable relative to a fixed section of the multiple sections to one of varying positions, and the varying positions comprise a raised tilt position where the adjustable section is raised above the fixed section, a substantially horizontal position where the adjustable section is substantially level with the fixed section, and a lowered tilt position where the adjustable section is lowered below the fixed section; and a rack layout adjustment device coupled to the utensil rack, wherein the rack layout adjustment device comprises a slide adjuster coupled to one end of the adjustable section via a rotatable member that pivots the adjustable section to a desired position in response to movement of the slide adjuster.

2. The apparatus of claim 1, further comprising:

a first guide track disposed along a first side of the utensil rack;

wherein the adjustable section comprises a first adjustable section; and wherein the slide adjuster comprises a first slide adjuster slidably coupled to the first guide track and interconnected with the first adjustable section, the first slide adjuster moveable along the first guide track to rotate the first adjustable section.

3. The apparatus of claim 2, wherein:

the rotatable member comprises a first rotatable member coupled to the first adjustable section; and the rack layout adjustment device further comprises a first connection mechanism interconnecting the first rotatable member with the first slide adjuster, the first connection mechanism triggering the first rotatable member to rotate the first adjustable section between the varying positions in response to the first slide adjuster moving along the first guide track.

4. The apparatus of claim 2, further comprising:

a second guide track disposed along a second side of the utensil rack;

wherein the multiple sections further comprise a second adjustable section; and wherein the slide adjuster further comprises a second slide adjuster slidably coupled to the second guide track and interconnected with the second adjustable section, the second slide adjuster moveable along the second guide track to rotate the second adjustable section.

5. The apparatus of claim 1, wherein:

the utensil rack further includes at least one set of recessing pins shaped to receive objects.

6. The apparatus of claim 1, further comprising:

a first guide track disposed along a first side of the utensil rack; and at least one moveable divider slidably coupled to the first guide track, each moveable divider separating two of the multiple sections and moveable along the first guide track to adjust a size of each of the two multiple sections.

7. The apparatus of claim 6, wherein:

each moveable divider includes a set of recessing pins shaped to receive objects.

8. The apparatus of claim 1, further comprising:

a detergent dispenser disposed within the utensil rack.

9. The apparatus of claim 8, wherein:

the detergent dispenser includes:

at least one interior compartment for maintaining detergent;

a sliding door moveable between an open position and a closed position; and a opening through which detergent maintained within the detergent dispenser is dispensed during a wash cycle.

10. The apparatus of claim 9, further comprising:

an actuator unit that actuates dispensing of detergent maintained within the detergent dispenser via the opening during a wash cycle.

11. The apparatus of claim 10, wherein the actuator unit comprises a solenoid.

12. The apparatus of claim 10, wherein the actuator unit is activated by water spray pressure during the wash cycle.

13. The apparatus of claim 10, wherein the actuator unit is integrated into the detergent dispenser.

14. The apparatus of claim 10, wherein the actuator unit is disposed within proximity of the detergent dispenser.

15. A dishwashing apparatus, comprising:

a dish rack;

a utensil rack comprising a bottom surface partitioned into multiple sections, wherein at least one of the multiple sections is an adjustable section individually rotatable relative to a fixed section of the multiple sections to one of varying positions, the varying positions comprise a raised tilt position where the adjustable section is raised above the fixed section, a substantially horizontal position where the adjustable section is substantially level with the fixed section, and a lowered tilt position where the adjustable section is lowered below the fixed section, and the utensil rack is disposed above the at least one dish rack;

a rack layout adjustment device coupled to the utensil rack, wherein the rack layout adjustment device comprises a slide adjuster coupled to one end of the adjustable section via a rotatable member that pivots the adjustable section to a desired position in response to movement of the slide adjuster; and a detergent dispenser disposed within one of the multiple sections of the utensil rack.

16. The apparatus of claim 15, wherein:

the detergent dispenser includes:

at least one interior compartment for maintaining detergent;

a sliding door moveable between an open position and a closed position; and a opening through which detergent maintained within the detergent dispenser is dispensed during a wash cycle.

17. The apparatus of claim 16, further comprising:

an actuator unit that actuates dispensing of detergent maintained within the detergent dispenser via the opening during a wash cycle.

18. The apparatus of claim 17, wherein the actuator unit comprises a solenoid.

19. The apparatus of claim 17, wherein the actuator unit is activated by water spray pressure during the wash cycle.

20. The apparatus of claim 17, wherein the actuator unit is integrated into the detergent dispenser.

21. The apparatus of claim 17, wherein the actuator unit is disposed within proximity of the detergent dispenser.

* * * * *